US006003747A

United States Patent [19]

Lee

[11] Patent Number: 6,003,747

[45] Date of Patent: Dec. 21, 1999

[54] STRUCTURE FOR GOLF-BALL BAG

[76] Inventor: Te-Chen Lee, P.O. Box 96-405, Taipei 10098, Taiwan

[21] Appl. No.: 09/107,197

[22] Filed: Jun. 26, 1998

[51] Int. Cl.[6] ..... A45F 5/00

[52] U.S. Cl. ..... 224/250; 224/674; 224/684; 224/251; 224/918; 224/919; 206/315.9; 383/41; D3/221; D3/224

[58] Field of Search ..... 224/918, 919, 224/191, 223, 660, 665, 674, 676, 682, 684, 235, 251, 250; 383/41; 206/315.1, 315.9; D3/221, 224, 8

[56] References Cited

U.S. PATENT DOCUMENTS

| | | | |
|---|---|---|---|
| D. 282,694 | 2/1986 | Gault | D3/221 |
| D. 289,226 | 4/1987 | Zisholtz | D3/221 |
| 1,911,256 | 5/1933 | Andrew | 224/919 X |
| 2,682,981 | 7/1954 | Previdi | 224/674 X |
| 4,416,404 | 11/1983 | Daniels | 224/676 |
| 4,433,803 | 2/1984 | Liberboim | 224/919 X |
| 4,821,933 | 4/1989 | Sebert | 224/904 X |
| 4,836,427 | 6/1989 | McManus | 224/919 X |
| 5,562,238 | 10/1996 | White | 383/41 X |
| 5,772,090 | 6/1998 | Rodriguez | 224/919 X |
| 5,839,631 | 11/1998 | Hebert et al. | 224/919 X |

*Primary Examiner*—Gregory M. Vidovich

[57] ABSTRACT

An improved structure for golf-ball bag, which mainly comprises a stop flap, a bag body and a bag lug; the stop flap and the bag body are made of a resilient material; the inner side of the stop flap is sewed with at least a bag lug; both ends of the bag body not connected with the stop flap are furnished with piping edges respectively; the other two ends of the bag body are sewed together with both ends of the stop flap respectively; the edge of the stop flap is furnished with piping edge; the ball bag has two openings, of which one opening has a higher flap panel extended from the stop flap; the ball bag can be attached to the belt of a user by means of bag lug; when a ball is loading into the bag, the flap panel is used as a guide surface for the ball; since the opening is resilient, the ball loaded in the bag would drop out unintentionally; to pick up the ball out of the ball bag, a user may simply squeeze the bag and push the ball out of the ball-output end.

1 Claim, 9 Drawing Sheets

STRUCTURE FOR GOLF-BALL BAG

BACKGROUND OF THE INVENTION

1. Field of the Invention

This invention relates to golf ball, and particularly to a bag body structure for golf ball.

2. Description of the Prior Art

Conventionally, the golf balls bought from a store usually have three balls packed in an elongate paper box with an opening at one end thereof, and then the paper box is covered with a resilient film. The user usually has the balls unpacked and loaded in a rigid container to facilitate carrying; the rigid container is an elongate box, in which several ball sockets are furnished for storing balls separately. The user may open the box to pick up one ball at a time for normal use. There is also another type of container, which is a cylindrical container for loading several balls; the container has an opening with a lid. The user may, in use, open the lid to pick up a ball.

Still another conventional ball container as shown in FIG. 11 is usually attached to a golf-club bag by means of a hook on one side thereof.

SUMMARY OF THE INVENTION

The prime object of the present invention is to provide a golf-ball bag structure, in which the bag body is made of a resilient material cut into shape; both ends of the bag body are to be sewed together with a stop flap of the bag, and then a ball bag is formed into shape; the inner side of the stop flap is sewed with a bag lug to facilitate the ball bag to be attached to a user's belt. Since the bag body is resilient, the ball loaded therein is held in place without dropping out; a user may pick a ball out of the ball bag by simply pushing the ball out of a ball-output end.

Another object of the present invention is to provide a golf-ball bag structure, in which the bag body is made of a resilient material cut into shape. The resilient material is made of a synthetic rubber cloth coated on both sides with a non-woven cloth, which can provide a suitable tension to hold the ball in place, and the ball therein is easy to press and slide out by a user.

Still another object of the present invention is to provide a golf-ball bag structure, in which the bag is made of a resilient material and a cloth for the stop flap to be sewed together into the bag. The inner diameter of the ball bag is slightly smaller than that of the golf ball. The stop flap extends above the bag opening at a given height to become a flap panel. When a golf ball is loading into the bag from the ball-input end, the flap panel can be used as a guide surface to facilitate the ball to push into the bag, and then the ball will be retained in place by means of the resilience of the bag.

A further object of the present invention is to provide a golf-ball bag structure, in which the inner side of the stop flap is sewed with a bag lug to facilitate the ball bag to be attached to a user's belt. To pick up a ball, a user may simply squeeze the bag to force the ball out.

A still further object of the present invention is to provide a golf-ball bag structure, in which the upper and lower openings of the bag body are furnished with piping edges to form into limit rings respectively, which can prevent the ball in the bag from dropping out unintentionally.

Yet another object of the present invention is to provide a golf-ball bag structure, in which the upper and lower openings of the bag body are furnished with tucked edges to form into limit rings respectively, which can prevent the ball in the bag from dropping out unintentionally.

DETAILED DESCRIPTION OF THE PREFERRED EMBODIMENT

Figure 1:
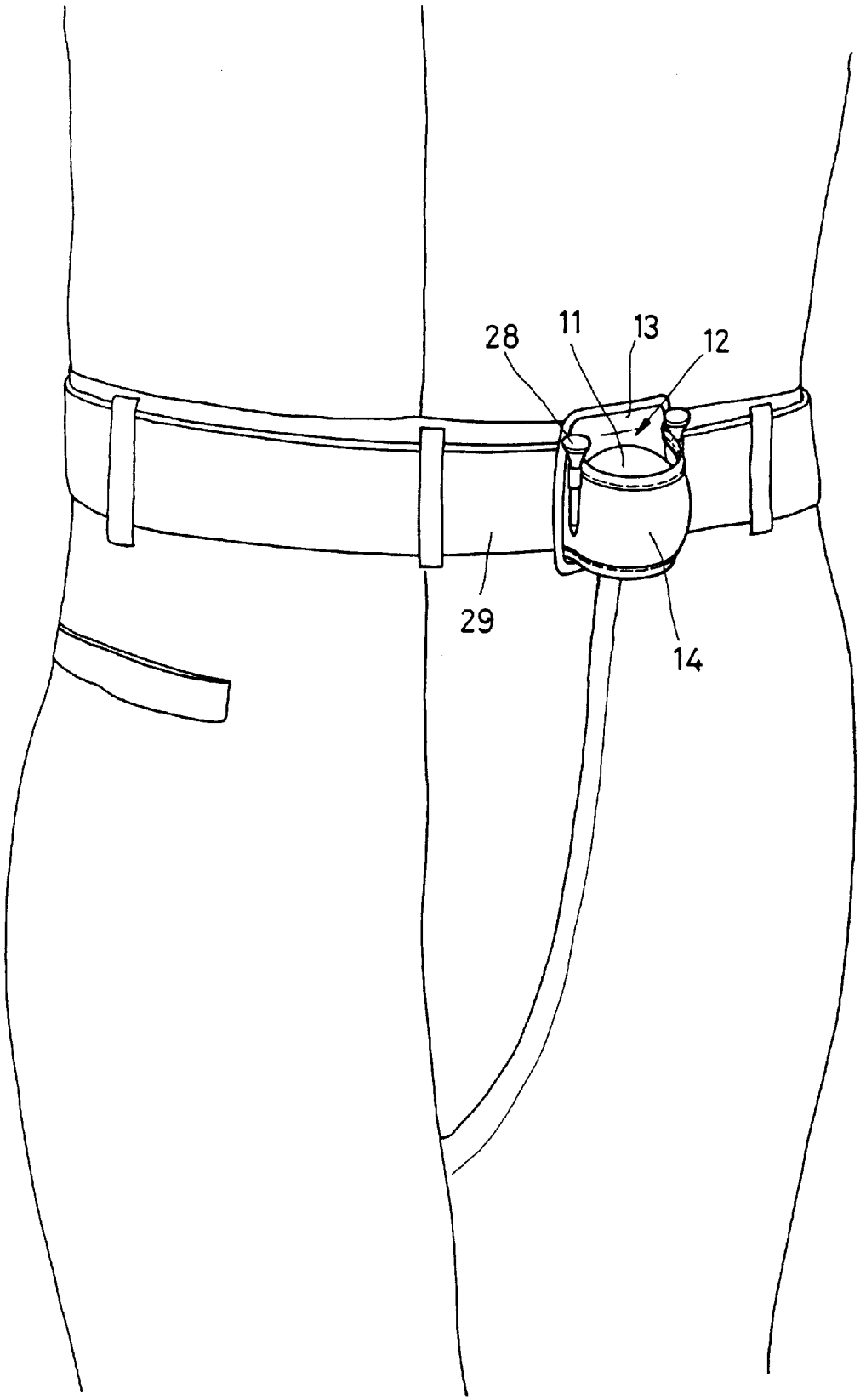
FIG. 1 shows a golf-ball bag fastened on belt of a person according to the present invention.
Figure 2:
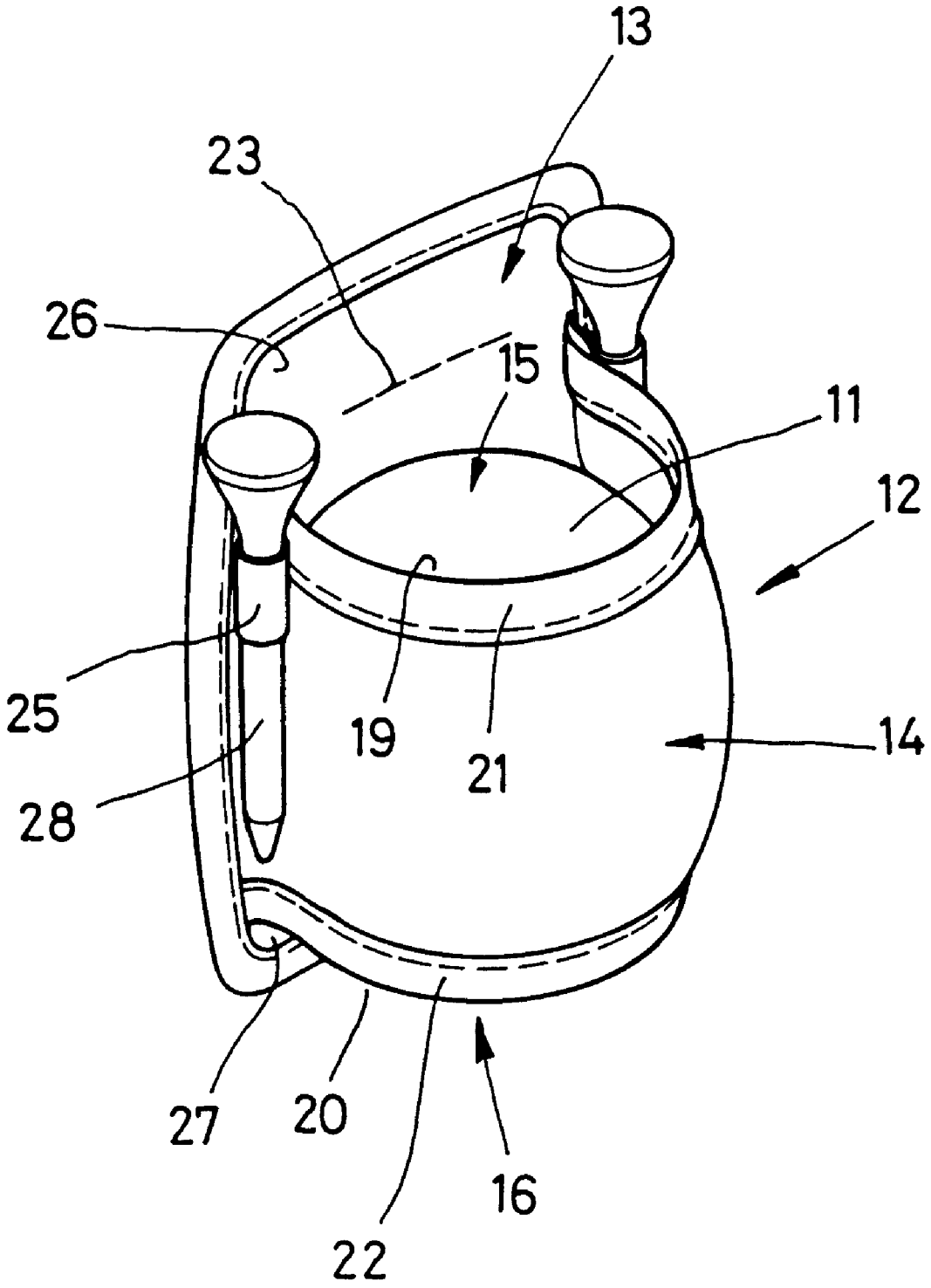
FIG. 2 is a perspective view of the present invention, showing a golf ball loaded in the bag.
Figure 3:
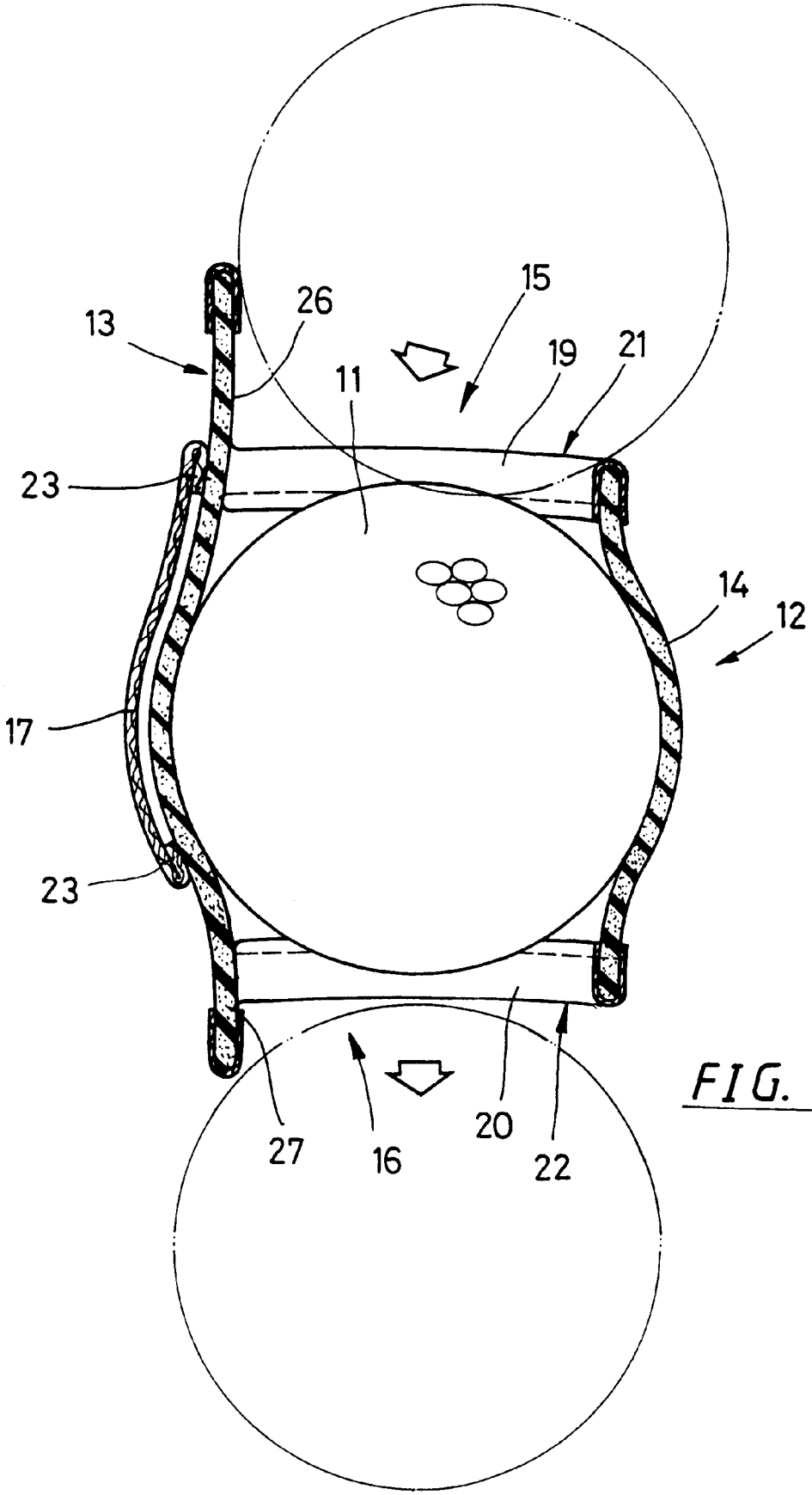
FIG. 3 is a sectional view of the present invention, showing a ball being loaded in the ball bag.

This invention relates to a golf-ball bag structure; as shown in FIGS. 1 to 3, the ball bag 12 comprises a stop flap 13, a bag body 14, and bag lug 17. The stop flap 13 and the bag body 14 are made of a resilient material pre-cut. A bag lug 17 is pre-sewed on the rear side of the stop flap. Both upper and lower edges of the bag body are piped or tucked before being sewed on the stop flap; after both edges of the bag body being sewed together with the stop flap, the upper and lower openings 19 and 20 form into two limit rings 21 and 22 respectively. Since the bag body 14 has a suitable resilience, the golf ball in the bag body would not drop out of the ball-output end 16 unintentionally.

The ball bag 12 for golf ball 11 is made of a resilient material to be cut in shape first for the stop flap 13 and the bag body 14; the resilient material is a synthetic rubber cloth, of which both sides are glued with a non-woven cloth. The ball bag 12 made of the aforesaid material has a given resilience to hold a ball 11 therein.

Figure 9:
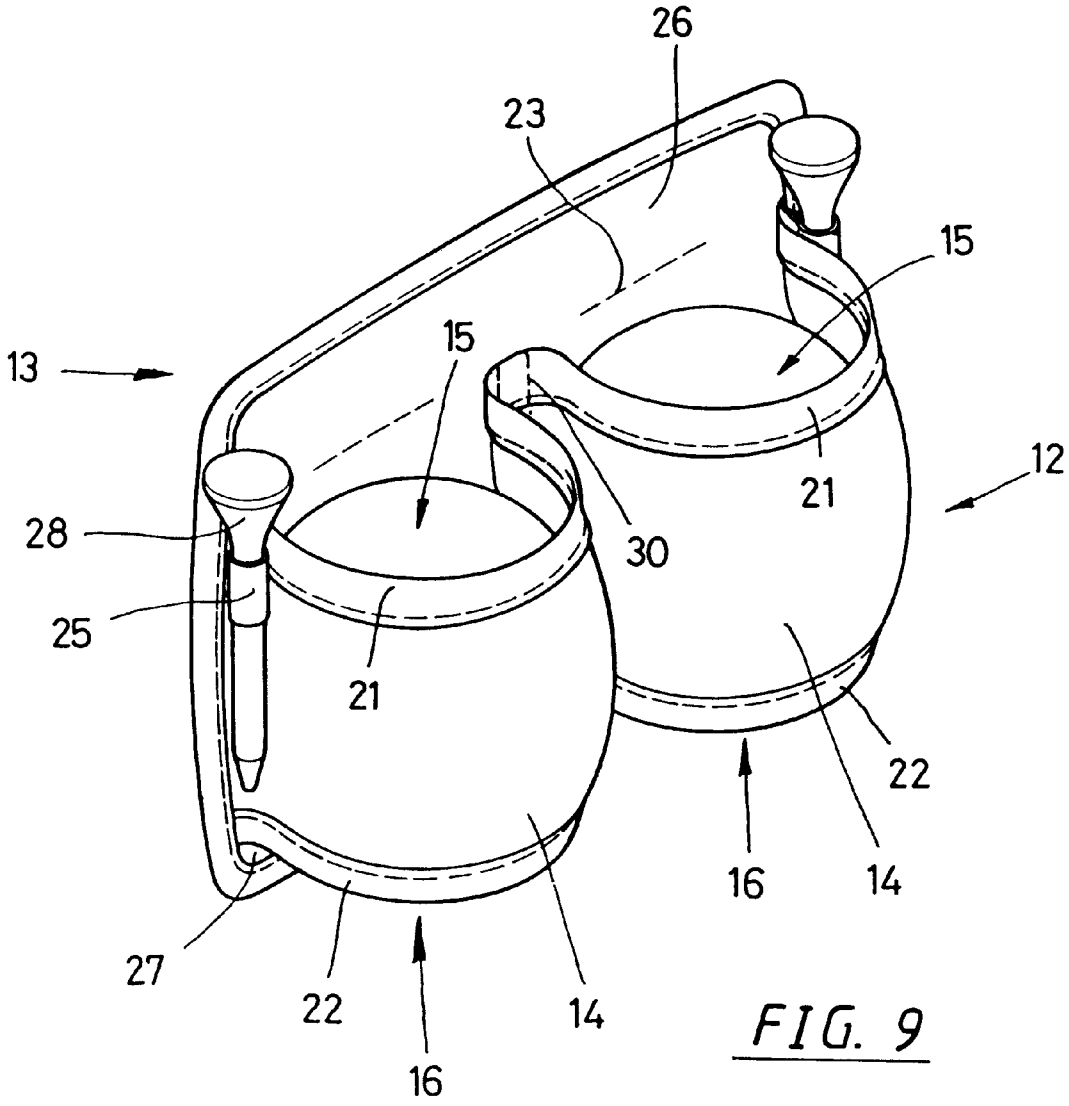
FIG. 9 is a perspective view of the present invention, showing embodiment-3 according to the present invention.
Figure 10:
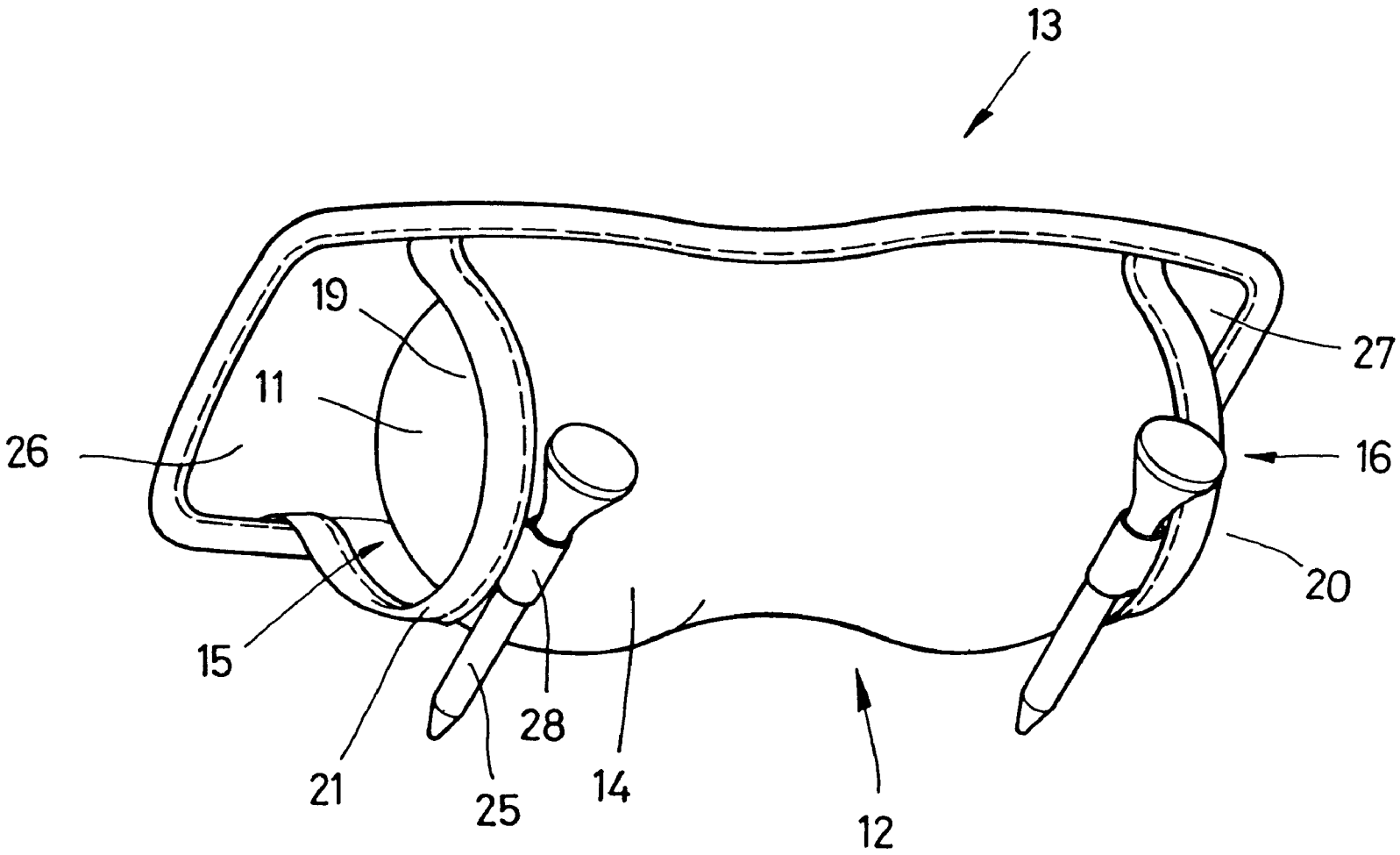
FIG. 10 is a perspective view of the present invention, showing embodiment-4 according to the present invention.
Figure 11:
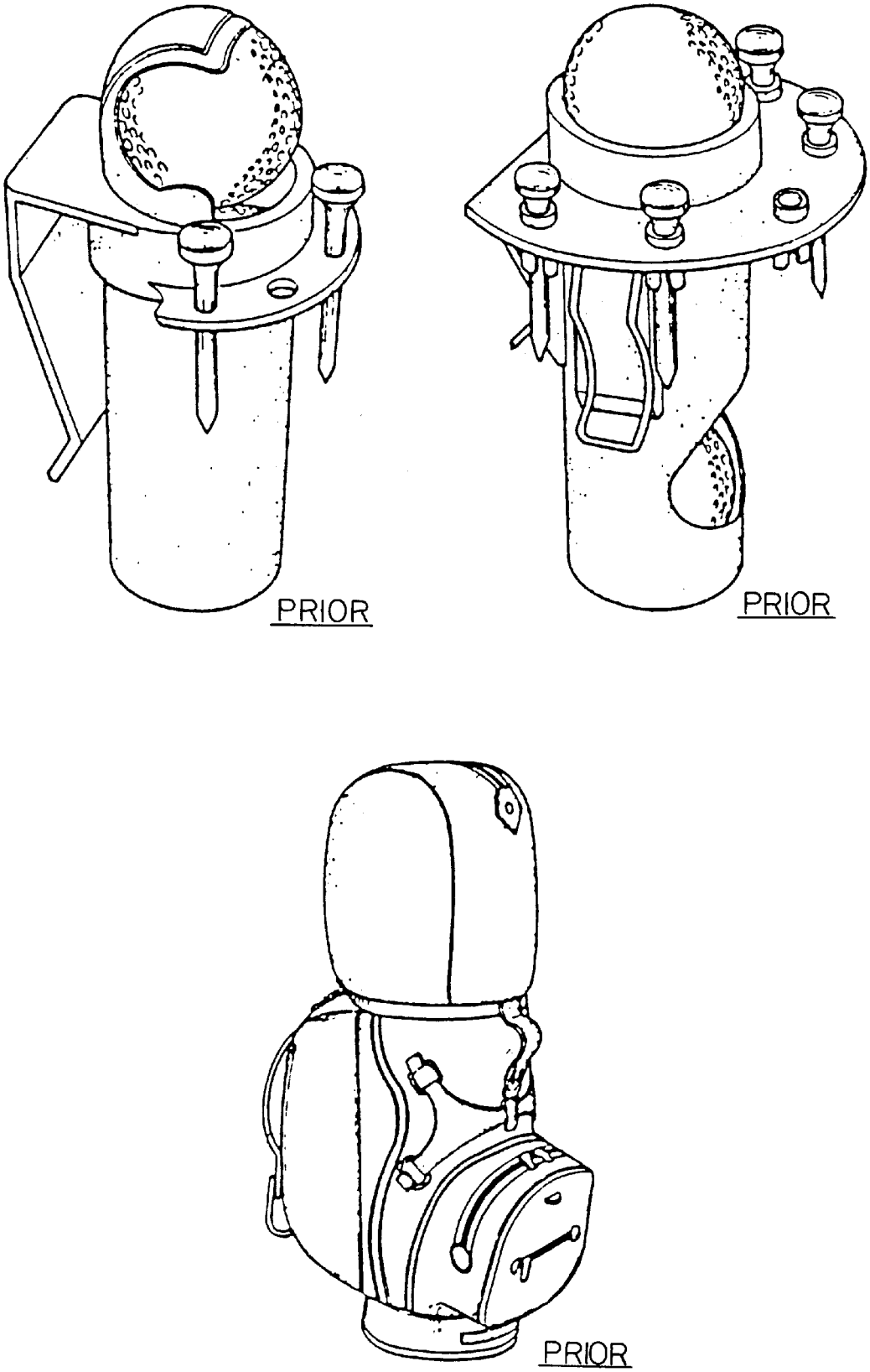
FIG. 11 is a perspective view of three conventional golf-ball bag.

The size of the ball bag 12 is hinged on the number of balls 11 to be loaded. The bag 12 is to be attached to the belt 29 of a person by means of a bag lug 17. Usually, a bag may be loaded with one or two balls preferably; therefore, the length of the bag body 14 and the direction of the ball-input end 15 will determine the shape of the bag body 14. As shown in FIG. 2, the ball bag 12 is designed for loading one ball 11; the ball-input end 15 faces upwards, while the ball-output end 16 faces downwards. The circumference, length and height of the bag body 14 are merely good for holding one ball 11. As shown in FIG. 9, the width of the stop flap 13 of the ball bag 12 has been increased to an extent of being good for loading two balls 11 by means of two ball chambers. As shown in FIG. 10, the ball-input end 15 and the ball output end 16 are designed in a horizontal position, and the ball chambers for two balls 11 are in communication with each other.

Figure 4:
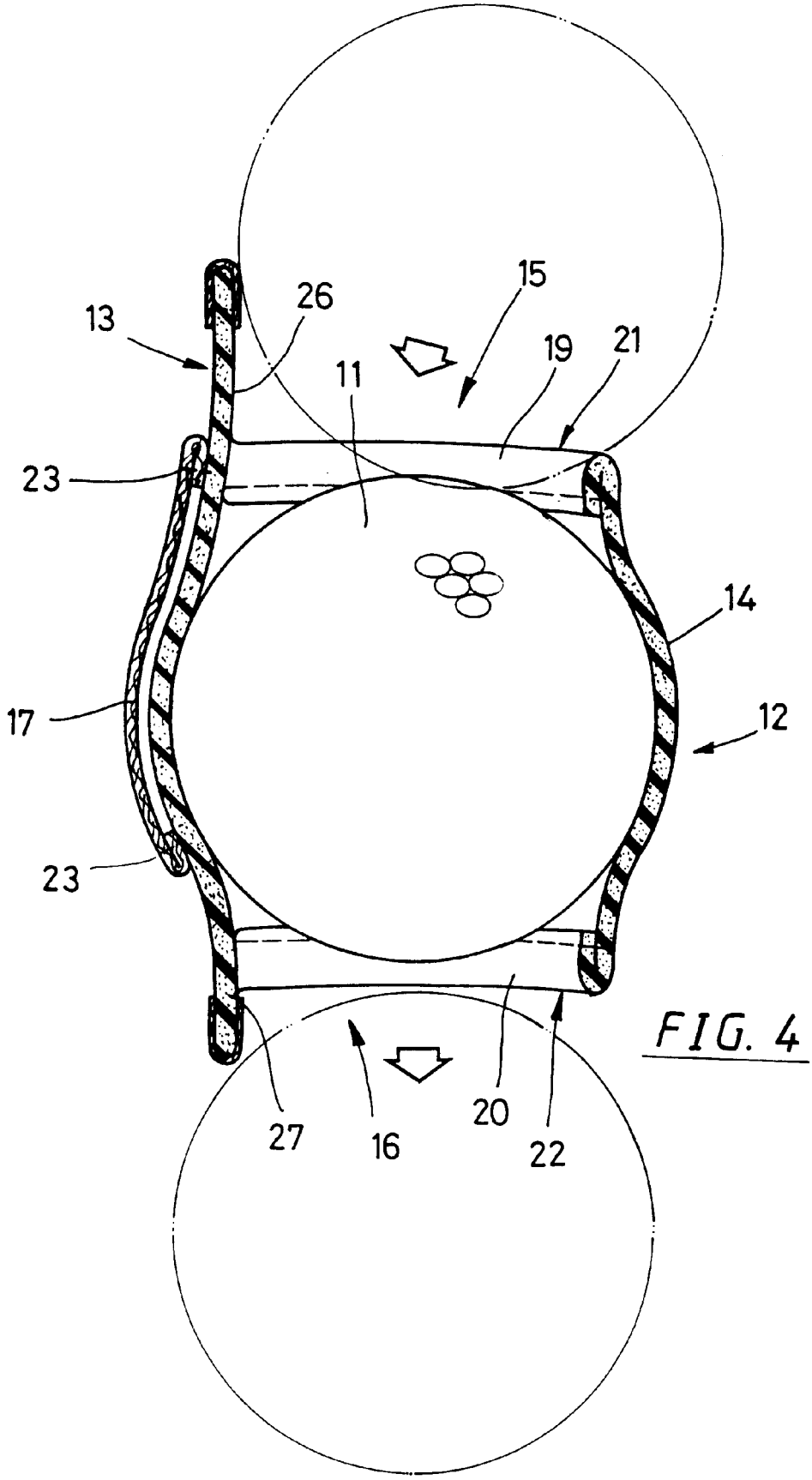
FIG. 4 is a sectional view of the present invention, showing embodiment-2 according to the ball bag.

Referring to FIGS. 1 to 3, the stop flap 13 and the bag body 14 of the ball bag 12 is made of a resilient material cut into a suitable size. A bag lug 17 at a suitable length is folded on the edge thereof before being sewed behind the stop flap 13 horizontally. As shown in FIG. 3, the bag body 14 is made of a resilient material with piping on the upper and lower edges thereof respectively. FIG. 4 shows the edge of the bag body 14 having a tucked edge on the upper and lower edges thereof. After the material for the stop flap 13 and the bag body being sewed on the edges thereof, it still maintains a suitable resilience.

The stop flap 13 is designed with a size higher than that of the bag body 14. Both upper and lower edges of the bag body 14 will be sewed, and then both left and right sides of the bag body 14 are attached together with both ends of the stop flap 13; both upper and lower ends of the stop flap 13 are over the height of both ends of the bag body 14, but the upper end of the stop flap 13 is longer than the lower end thereof. Both ends of the bag body 14 and the edge of the stop flap 13 are sewed together in a piping edge; at the same time, the two fastening rings 25 are also sewed into the piping edge on both ends of the bag body 14; then, a single ball bag 12 is completed. The bag lug 17 mounted on inner side of the stop flap 13 is used for facilitating a belt 29 to pass through to attach around a user's waist; the fastening rings 25 are used for plugging the tees 28.

Both upper and lower ends of the bag body 14 are sewed into a piping or a tucked edge; the openings of the bag body 14 have a given resilient force to form into an upper and lower limit rings 21 and 22 respectively to prevent the ball 11 form moving unintentionally. The stop flap 13 extends above the limit ring 21 at a given length to form into a flap panel 26, while the stop flap 13 also extends below the limit ring 22 at a given length to form into a flap panel 27. The flap panel 26 is longer than the lower flap panel 27.

The stop flap 13 and the bag body 14 are sewed together. The upper opening 19 of the bag body 14 and the upper flap panel 26 of the stop flap 13 are formed into a ball-input end 15. The size of the upper opening 19 of the bag body 14 is slightly smaller than the diameter of the golf ball 11 because of the limit ring 21 having a resilient force on the ball-input end 15. The size of the lower opening 20 of the bag body 14 is also smaller than the diameter of the golf ball 11 as a result of the limit ring 22; therefore, the golf ball 11 loaded in the bag body 14 would not drop out because of the resilient force of the bag body 14.

The bag lug 17 sewed on the inner side of the stop flap 13 is used to set the bag in place upon the belt 29 mounted through. The stop flap 13 is sewed on the upper and lower ends of the bag lug 17 by means of horizontal stitches 23; the horizontal stitch part has no resilience, while the part other than the stitch part would have a better resilience. A golf-ball can be loaded in the ball bag 12 upon the bag 12 fastened on a belt or otherwise; when loading a ball, the upper opening 19 and the flap panel 26 of the stop flap 13 can be used simultaneously so as to have the outer side of the ball 11 move against the upper opening 19, and to have the inner side of the ball 11 move against the flap panel 26; in that case, the ball can be pushed down in a better and guide manner; in other words, the ball can be loaded in the bag body 14 smoothly; then, the ball will be held in place by means of the resilient bag, and the upper and lower limit rings 21 and 22 without dropping out of the ball-output end 16 unintentionally.

The limit ring 22 of the lower opening 20 is used for holding the ball 11 in place. A flap panel 27 is furnished behind the inner side of the limit ring 22, and its function is to facilitate sewing a piping edge for the stop flap 13.

Figure 5:
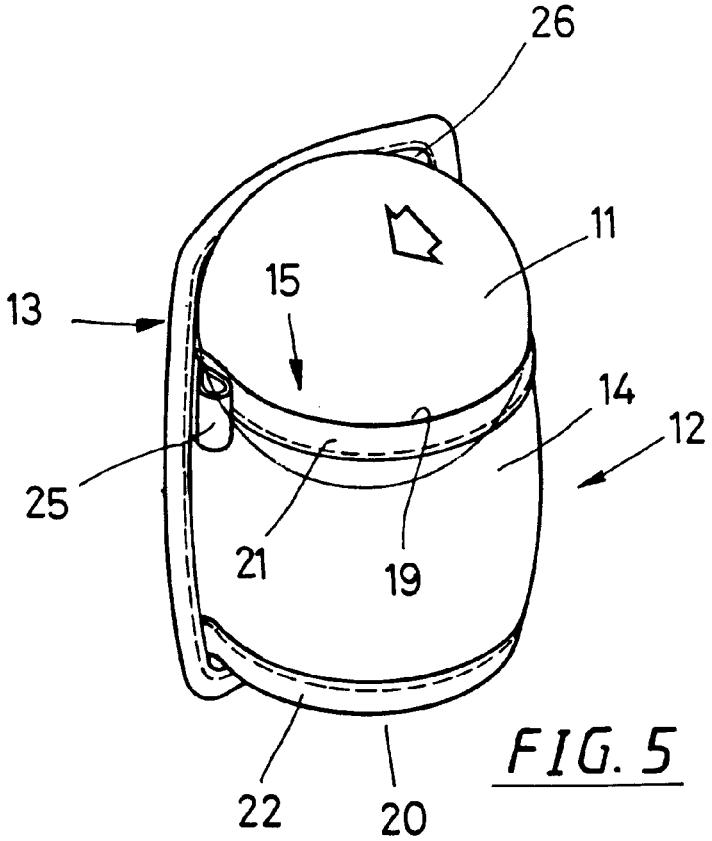
FIG. 5 is a perspective view of the present invention, showing a ball being loaded into the bag.
Figure 6:
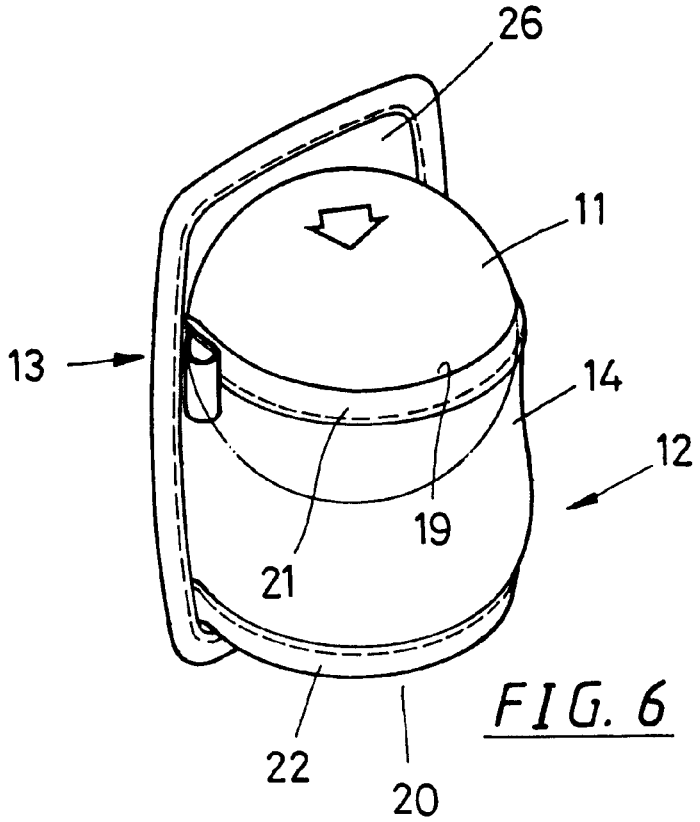
FIG. 6 is a perspective view of the present invention, showing a ball being pushed into the bag.
Figure 7:
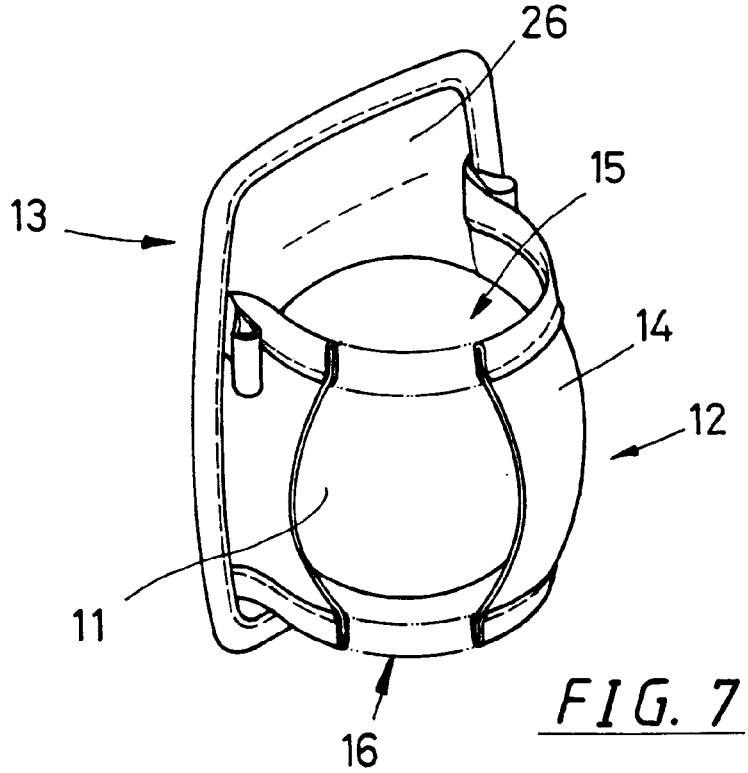
FIG. 7 is a sectional view of the present invention, showing the bag loaded with a ball.
Figure 8:
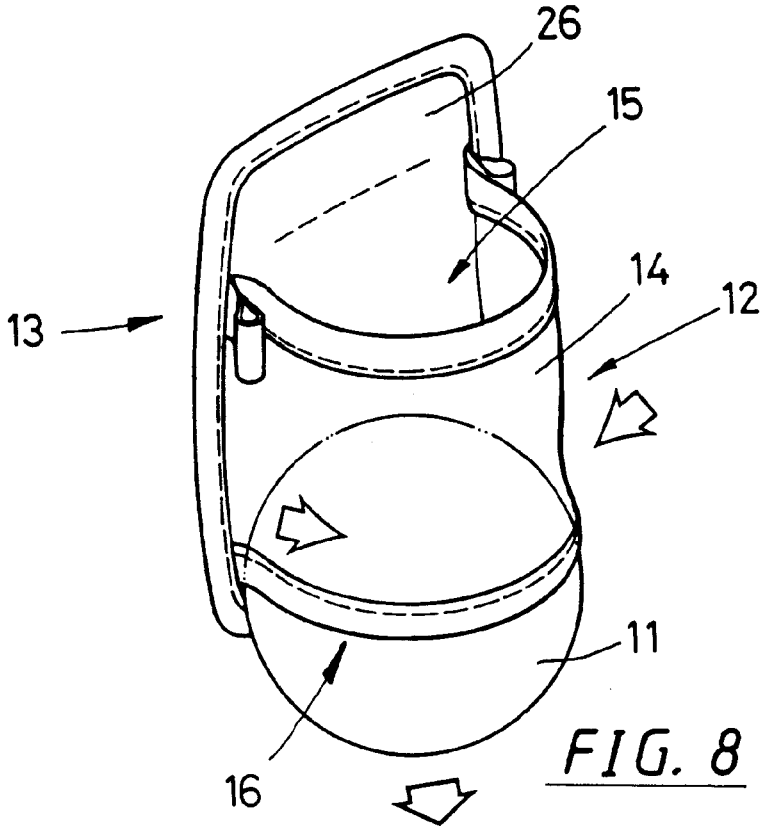
FIG. 8 is a perspective view of the present invention, showing a ball being squeezed out of the bag.

As shown in FIGS. 1 to 8, the ball bag 12 attached to the belt 29 is a single bag body 14 for loading only one ball 11. To load a ball, a user has to have the ball contacted the ball-input end 15 and the flap panel 26 (as shown in FIGS. 3 and 5); then, the ball 11 will slide and move downwards as a result of the stopping effect of the flap panel 26, and will open the limit ring 21 (as shown in FIG. 6) to drop into the bag body 14 (as shown in FIGS. 3 and 7). The ball 11 dropped in the bag body 14 would not drop out as a result of the diameters of the limit rings 21 and 22 being smaller than that of the ball 11, and the resilience of the ball bag 12.

Since the ball bag 12 can be mounted, with the bag lug 17, on the belt 29, it can be carried by a user to move around. To pick up the ball 11, the user may simply push the ball 11, with finger, from the upper opening of the bag body 14 to force the ball 11 to move downwards and to drop out of the limit ring 22 of the lower opening 20, and to drop out of the ball-output end 16.

In the single ball bag 12, two fastening rings 25 are sewed between the bag body 14 and the stop flap 13 on both sides thereof respectively; the fastening rings 25 are used for plugging tees therein respectively, which are used for driving a ball.

According to the present invention, the stop flap 13 extends upwards to furnish a flap panel 26 along the inner side of the bag body 14; before loading a ball 11 into the ball bag 12, the ball 11 has to contact with the flap panel 26, which is used as a guide surface to direct the ball 11 to slide into the ball bag 12, and then the ball 11 will be held in place.

This invention can provide a ball bag 12 for loading one ball 11, and also can provide a ball bag 12 for loading two balls 11. As shown in FIG. 9, the ball bag has a stop flap 13 wider than that of the aforesaid embodiment. Two bag lugs are sewed on the inner side of the stop flap 13 with two horizontal stitches 23 (on upper and a lower parts of the stop flap). The outer side of the stop flap 13 is designed to have a bag for two balls 11. The bag is divided into two separate bags by means of mid-stitches 30. FIG. 10 shows a ball bag 12, of which the ball-input end 15 and the ball-output end 16 are designed on both ends of the bag body 14; the ball bag 12 has a through space horizontally. The inner side of the stop flap 13 is also sewed with a bag lug to facilitate attaching the bag on a belt. When loading or picking a ball, the flap panel 26 of the stop flap 13 extended longer than the upper opening 19 is used for guiding the ball. Either the upper opening 19 or the lower opening 20 can be used as a ball input or output end.

What is claimed is:

1. A golf ball bag for holding at least one golf ball, said bag comprising:

a stop flap; at least one bag lug, and a bag body;

said stop flap being made of a resilient material pre-cut into shape, said stop flap having front and back sides, upper and lower sides, and opposing lateral sides, said at least one bag lug having upper and lower edges folded on itself and respectively sewn on said back side of said stop flap and adapted to receive a belt worn by a person, said bag body made of a resilient material pre-cut into shape and having upper and lower edges and opposing lateral edges, said opposing lateral edges of said bag body respectively sewn in a piping edge to said lateral sides on said front side of said stop flap between said upper and lower sides thereof so as to define an upper opening defined by said upper edge of said bag body and said stop flap and a lower opening defined by said lower edge of said bag body and said stop flap, said stop flap sized so as to extend upwardly from said upper opening to define a first panel and downwardly from said lower opening to define a second panel wherein said first panel extends further than said second panel, said upper and lower edges of said bag body each furnished with limit ring means for securing a golf ball in said bag wherein said upper opening defines a ball input end and said lower opening forms a ball output end, wherein a golf ball is adapted to be inserted into said input end with said first panel performing as a guide surface so as to let the golf ball slide downwards into the bag and said ball being held therein by said limit ring means which prevents unintentional withdrawal of the golf ball from said bag.

* * * * *